US005419171A

United States Patent [19]

Bumgarner

[11] Patent Number: 5,419,171

[45] Date of Patent: May 30, 1995

[54] ISOSTATIC BULGE FORMING

[75] Inventor: John R. Bumgarner, Renton, Wash.

[73] Assignee: The Boeing Company, Seattle, Wash.

[21] Appl. No.: 136,646

[22] Filed: Oct. 14, 1993

[51] Int. Cl.[6] ..... B21D 26/06

[52] U.S. Cl. ..... 72/62; 72/56; 29/421.1

[58] Field of Search ..... 72/54, 56, 60, 61, 62; 29/421.1

[56] References Cited

U.S. PATENT DOCUMENTS

| | | | |
|---|---|---|---|
| 2,372,917 | 4/1946 | Tuttle | 153/73 |
| 2,442,801 | 6/1948 | Pietro | 261/11 |
| 3,090,113 | 5/1963 | Karpovich | 72/56 |
| 3,359,624 | 12/1967 | Cours et al. | 29/421 |
| 3,462,821 | 8/1969 | Cours et al. | 29/200 |
| 3,463,035 | 8/1969 | Bright | 76/107 |
| 3,564,886 | 2/1971 | Nakamura | 72/62 |
| 3,685,327 | 8/1972 | Nakamura | 72/57 |
| 3,858,422 | 1/1975 | Tominaga et al. | 72/62 |

FOREIGN PATENT DOCUMENTS

| | | | |
|---|---|---|---|
| 239625 | 4/1965 | Austria | 72/56 |
| 305623 | 6/1971 | U.S.S.R. | 72/56 |
| 0631242 | 11/1978 | U.S.S.R. | 72/61 |

*Primary Examiner*—David Jones
*Attorney, Agent, or Firm*—Elizabeth F. Harasek

[57] ABSTRACT

A method and apparatus are provided for isostatically bulge forming tube stock. The tube is assembled in sealing arrangement with a split die. The assembly is placed in a pressure vessel wherein an non-compressible fluid is pressurized to form the tube into the die cavities. Because the force on the tooling is compressive in nature, relatively low strength, low cost tools may be used.

6 Claims, 5 Drawing Sheets

ISOSTATIC BULGE FORMING

This invention relates to a novel method of forming metal tubes with complex contours by application of isostatic pressure in a specially adapted apparatus.

BACKGROUND

Many metal ducts and tubes having very irregular bends, bulges and indentations are used in commercial aircraft. These are principally used to duct air from one location to another. The most harsh environment, and the one requiring the most convoluted metal tubes, is the ducting of hot exhaust gases from jet engines.

Some such ducts which are relatively straight and not harshly bulged or indented are shaped by conventional bulge forming methods. U.S. Pat. No. 2,372,917 to Tuttle shows a conventional method of bulge forming a tube in a split female tool. A liquid is pressurized in the interior of the tube while pressure is vented from the tool cavities. German 24 42 801 to Seizo also shows a bulge forming method featuring an intermediate fluid filled chamber to accomplish pressurization of the forming liquid. U.S. Pat. No. 3,564,886 shows a similar bulge-forming method in a vented tool. U.S. Pat. Nos. 3,359,624 and 3,462,821, both to Cours et al., are of general interest as background for pipe forming using certain bulge forming techniques.

Prior art FIG. 1 shows a conventional bulge forming apparatus 1. Apparatus I consists of an upper platen 2 and lower platen 4. Jig collar 6 holds first die half 8 and second die half 10 together with tube 12 therebetween. Tube 12 is formed to match interior contour 14 of dies 8 and 10 by pushing bottom a piston 16 and top piston 22 together. An incompressible fluid 20 is fed into to 12 through inlet 18 in piston 16. Air is simultaneously evacuated through outlet 24 in top piston 22. When all the air is gone, a valve 26 on outlet 24 is closed and pressure is applied to fluid 20 causing tube 12 to bulge into dies 8 and 10. While this method is effective, it has a number of limitations. It requires a high tonnage press and high strength machined tools that will withstand the application of hydraulic pressures up to 20,000 psi. While the method may be cost effective where thousands of parts are to be made, it is very expensive to provide a high tonnage press and such tooling for short run pads. Moreover, the process generally lends itself only to the manufacture of rather straight tubes of rather short length and small interior volume. The method also generates substantial scrap above and below the bulge formed section of pipe.

Most part runs of large tubes and ducts for commercial airplanes are short, forming has conventionally been done by hammer forming small segments and then welding them together. While tooling costs for this method are relatively low, it is very labor intensive and difficult to control quality.

It is the object of this invention to provide novel, isostatic bulge forming equipment and methods which overcome the shortcomings of this prior art.

BRIEF SUMMARY

In accordance with a preferred embodiment of the invention, a metal tube is formed by an isostatic bulge forming method. The apparatus comprises a fluid pressure chamber having a valved inlet and a valved outlet for the forming fluid. The forming assembly comprises mated tool halves which are retained in a fixturing tube.

The tube to be formed is inserted in the tool. annular caps on the top and bottom of the assembly form a fluid tight seal with the tube to be formed and the retaining tube.

To form the tube, the chamber is filled with fluid. The fluid surrounds the entire forming assembly. The fluid in the chamber is pressurized and the tube bulges into the compressible air spaces in the tool. Once the tune is formed, the pressure on the fluid is relieved, the assembly is removed from the chamber and the part is removed from the assembly.

Because equal forces are applied to both sides of the tools in the chamber, there is no need for high strength tooling. The isostatic nature of the pressure application to an unrestrained assembly allows considerable latitude for bent and contorted tube shapes. My invention will be better understood in view of the several figures described below and the Detailed Description which follows.

FIGURES

DETAILED DESCRIPTION OF THE INVENTION

Figure 1:
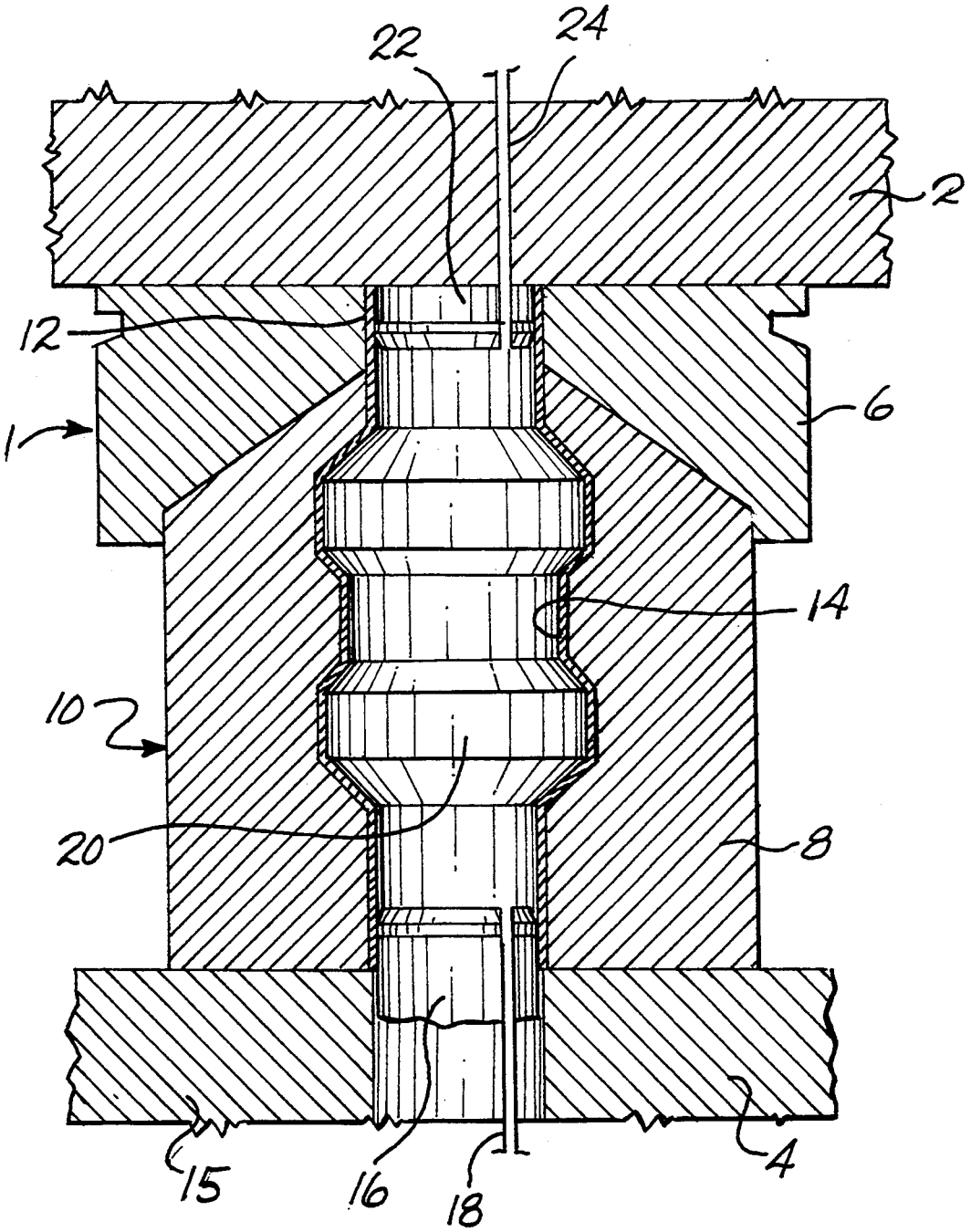
Fig. 1 PRIOR ART
FIG. 1 is a cross sectional view of a typical tooling for prior art bulge forming methods.
Figure 2:
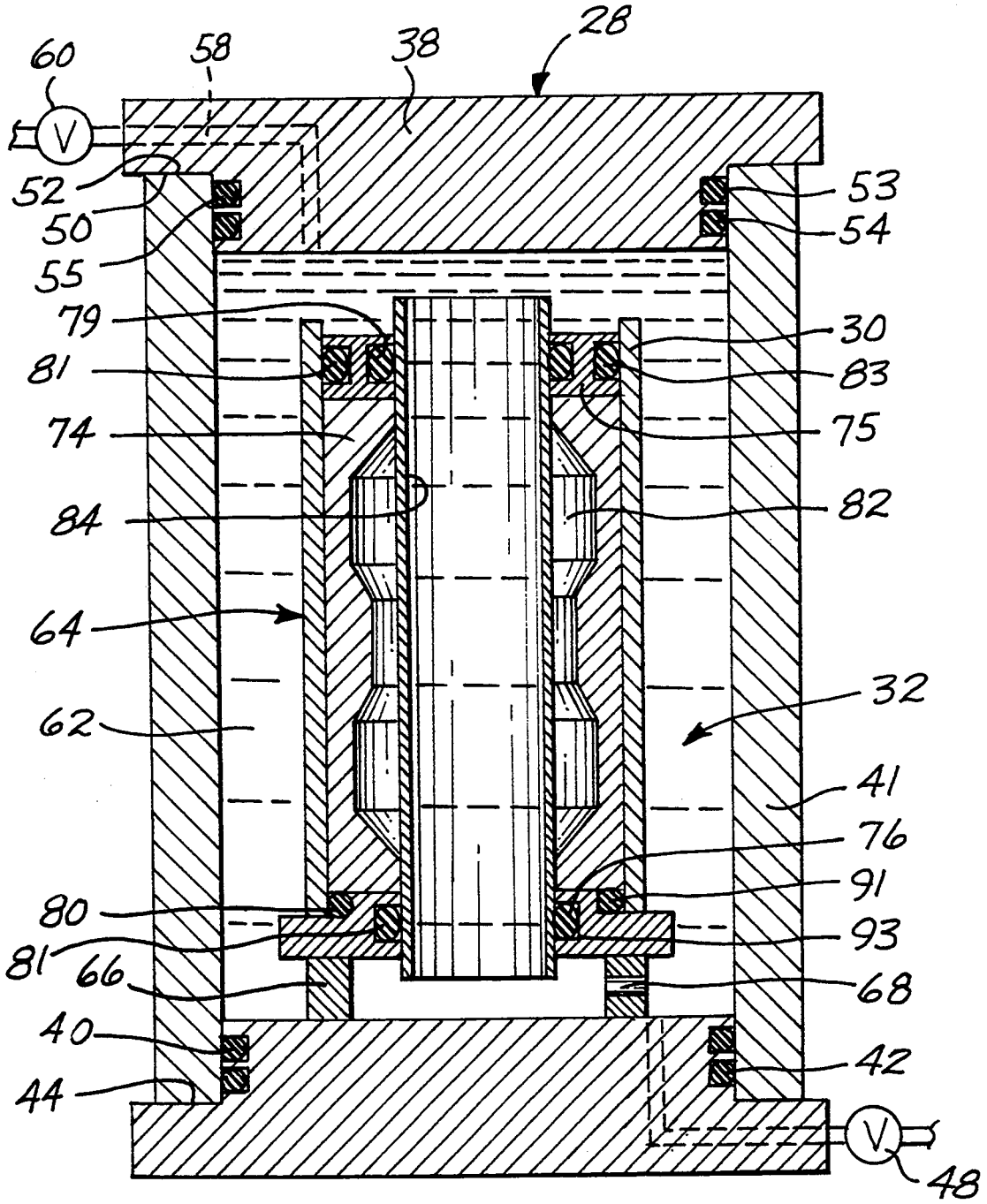
FIG. 2 is a cross sectional view of an isostatic bulge forming apparatus of the invention showing a pressure vessel and liquid chamber and a tooling assembly contained therein. The workpiece (tube) is shown in the preworked state.
Figure 3:
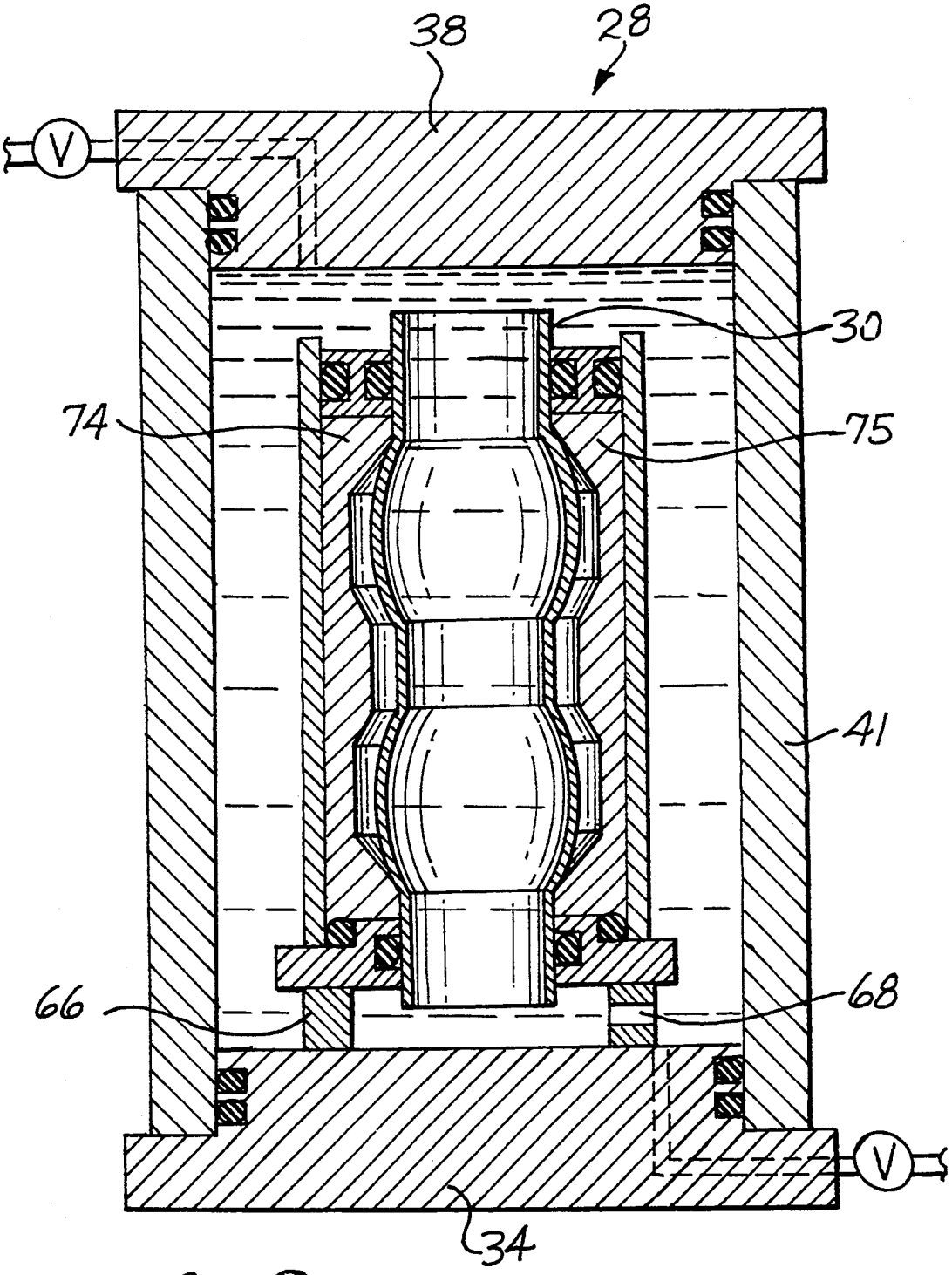
FIG. 3 is similar to FIG. 2 but shows the workpiece in a partially, isostatically bulge formed state.
Figure 4:
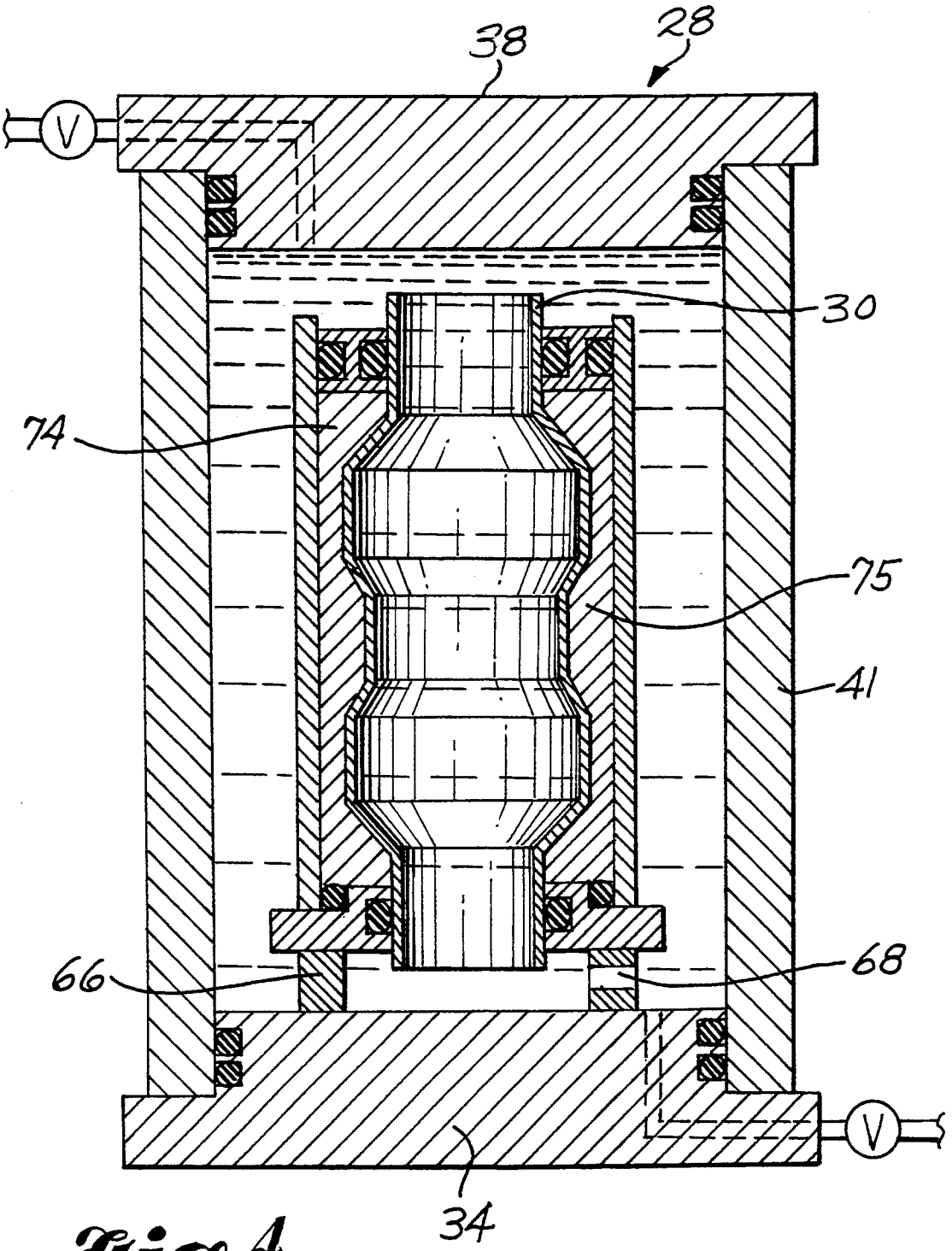
FIG. 4 is similar to FIGS. 2 and 3 but shows the workpiece in the fully formed state.

FIGS. 2–4 show a cross sectional view of an apparatus 28 for forming a tube 30 of metal or other malleable material. Apparatus 28 comprises isostatic bulge forming chamber 32 formed by bottom cap 34, thick-walled cylinder 36, and top cap 38. O-rings 39 and 40 are seated in grooves 41 and 42, respectively and form fluid and air-tight seals between bottom cap 34 and cylinder 36. Cylinder 36 rests on shoulder 44 of bottom cap 34. Line 46 runs through bottom cap 34. Valve 48 controls flow of pressurized fluid through line 46.

Top cap 38 has shoulder 50 which overhangs top edge 52 of cylinder 36. O-rings 53 and 54 are seated in grooves 55 and 56, respectively and form fluid and air-tight seals between top cap .38 and cylinder 36. Line 58 runs through top cap 38. Valve 60 controls flow of pressurized fluid through line 58. Assembly 28 is confined in a frame or press (not shown) which prevents unseating of top cap 38 when fluid 62 is introduced into chamber 32 at pressures sufficient to accomplish isostatic bulge forming. Top cap 38 can move up and down with respect to cylinder 36 to the extent that the seals with O-rings 53 and 54 are not broken. This allows assembly 28 to be easily shuttled into a fixed height frame. When fluid 62 is added to chamber 32, top cap 38 is pushed up to meet the frame allowing no further movement thereof, even when high pressure is created within chamber 32.

Tooling fixture 64 is located within chamber 32 and rests on retainer ring 66 which has holes 68 to allow free flow of fluid around and through it. Fixture 64 comprises tool sleeve 70, tool end cap 72, annular top cap 73, die halves 75 and 76, and workpiece or tube 30. O-rings 76 and 77 in grooves 78 and 79 form air and fluid tight seals between workpiece 30 and end cap 72 and annular cap 73. Similarly, O-rings 80 and 81 in grooves 82 and 83 form air and fluid tight seals between end cap 72 and annular cap 73 and tool sleeve 70. Complementary die halves 74 and 75 fit snugly within the sealed confines of tool sleeve 70 and tube 30.

Referring particularly to FIG. 2, tooling fixture 64 is assembled before it is placed in chamber 32. Forming spaces 82 between die halves 74 and 75 and tube to be formed 30 are, therefore initially contain air at atmospheric pressure.

To perform the subject isostatic bulge forming method, chamber 32 is filled with an incompressible fluid 62, such as water or oil, through line 46. Air is vented through line 58. Valve 60 is closed when chamber 32 if filled. Fluid 62 is pressurized by means of a suitable pump to a pressure sufficient to push against inner wall 84 of tube 30 and force it into forming space 82. Air in 82 is simply compressed, vented into chamber 32, or forced into a retaining chamber dies 74 and/or 75 (not shown). If desired, forming space 82 may be evacuated before chamber 32 is pressurized. The small amount of residual air pressure in nonvented die is generally not enough to cause any springback of a formed tube.

FIG. 3 shows tube 30 in a partially formed state. FIG. 4 shows the tube fully formed.

After isostatic bulge forming is complete, the pressure on fluid 62 is relieved, fluid 62 is drained through line 46, and tooling fixture 64 is disassembled and the formed tube 30 removed.

In an alternative embodiment, forming space 82 is vented (not shown) to chamber 32 and also filled with pressurized fluid 62 until correct working pressure is reached and maintained on both sides of tube 30. Chamber pressure is then vented allowing the working pressure to rapidly form tube 30 against dies 74 and 75.

Figure 6:
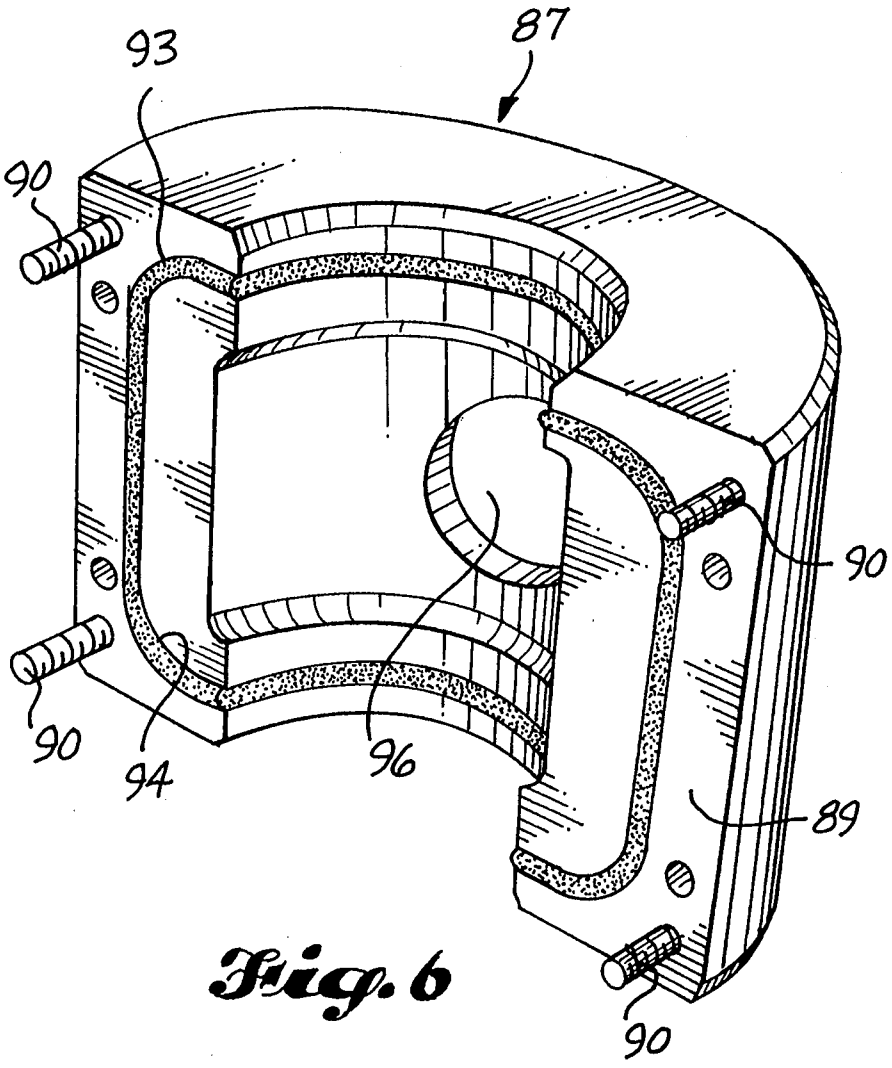
FIGS. 5 and 6 show complementary tool halves of the type used in the subject apparatus and method.
Figure 5:
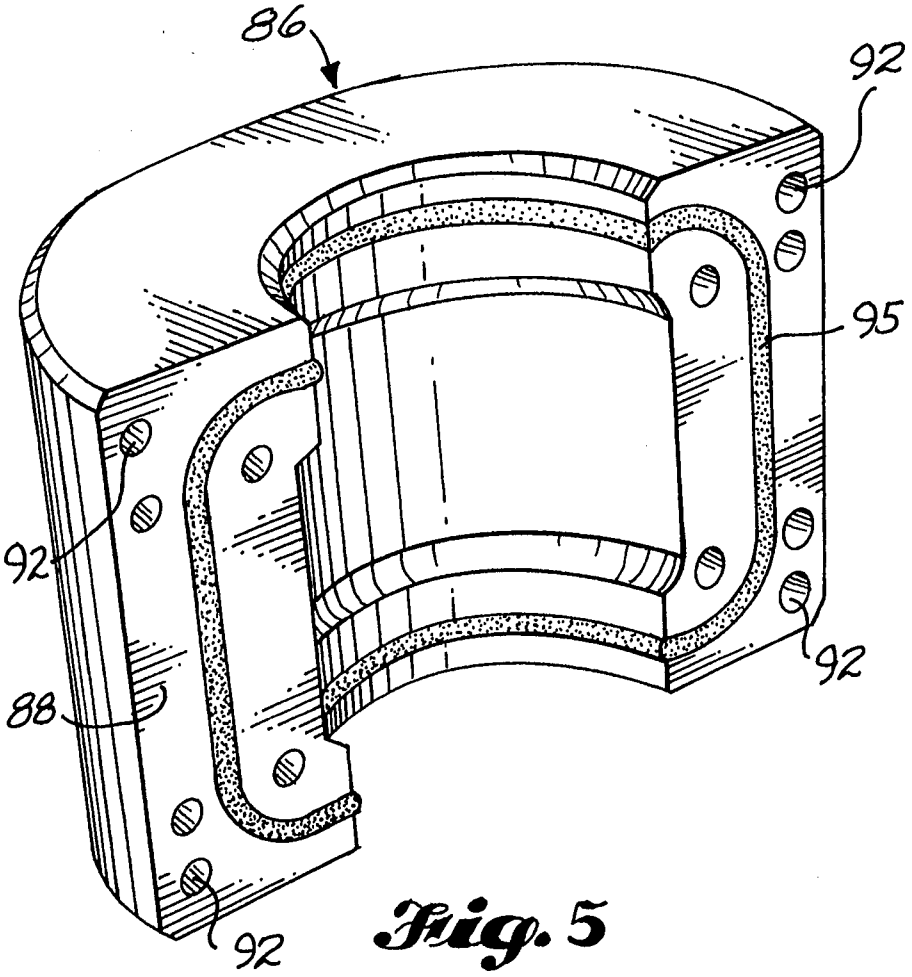

FIGS. 5 and 6 shows dies 86 and 87 which were used in such an isostatic bulge forming process. Halves 86 and 87 mate along surfaces 88 and 89. Locating pins 90 seat in holes 92 when the tool is assembled. O-rings 93 in groove 94 seats and seals in groove 95 to make sure the halves 86 and 87 seal tightly. Hole 96 in die 87 allows the workpiece to protrude through it during forming so the protrusion can be easily knocked out.

In a preferred practice of the invention, the pressure vessel in which the isostatic bulge forming takes place is comprised of a thick walled pipe. For example, a pressure vessel may be machined from a cast iron pipe. A typical vessel pipe size for forming stainless steel aircraft exhaust tubes is a 4 inches thick, 28 inches long and has an inside diameter of 18 inches. The end caps may be machined from steel, and 90 durometer urethane O-rings have been found to form adequate seals. Generally, forming pressures in the range of about 10,000 p.s.i. have been found adequate to form stainless steel exhaust tube stock. Other higher or lower pressures would be suitable to form other materials. Tube stock thickness will also influence the amount a pressure needed to isostatically bulge form a workpiece.

Significant advantages of the subject invention over prior art bulge forming include the features that the forming can take place at room temperature and that the tooling is relatively cheap. Conventional practices require tools that can withstand forming pressures of 10,000 to 20,000 psi in one direction. This generally means that tooling must be machined from high strength tool steels.

The subject invention merely requires that the dies have adequate compressive strengths. This allows the manufacture of tools by casting polymeric or metallic materials around forms or existing parts. For example, nylon and kirksite could be used as a die materials. Tooling fixtures also need not be made from high tensile strength materials. For example, aluminum retaining rings and end caps have been found to be acceptable. The method is particularly useful for consistently and inexpensively producing short runs of high quality parts.

While my invention has been described in terms of specific embodiments thereof, other forms may be readily adapted by one skilled in the art. Accordingly, the scope of my invention is to be limited only in accordance with the following claims.

I claim:

1. A method of forming a tube having an inner and an outer surface comprising the steps of retaining said tube in a tooling fixture comprising a forming die, said die having an interior working surface in the desired shape to be formed from the tube and a top collar and a bottom collar sized and shaped to match the outer surface of the tube such that a non-compressible fluid tight seal is formed between the said top and bottom collars of the forming die and the outside surface of the tube and a forming space is defined between the outer surface of the tube and the working surface of the die, and such that a compressible gas or vacuum is located in the forming space between the tube and the forming die; placing the tooling fixture into an isostatic pressure chamber; filling said chamber with an incompressible fluid; and raising the pressure of said fluid in said chamber to a pressure at which said tube is deformed by application of pressure on the inner surface of the tube and by the movement of the outer surface of the tube into the forming space and against the working surface of the die whereby the outer surface of said tube is (and) shaped to match the working surface (forming surfaces) of said die.

2. The method of claim 1 where the tube is stainless steel.

3. The method of claim 1 where the non-compressible fluid is oil.

4. The method of claim 1 where the non-compressible fluid is at room temperature.

5. An apparatus for isostatically bulge forming tubes having an inner and outer surface, the apparatus comprising a pressure chamber for retaining a high pressure non-compressible liquid; a tooling fixture that fits within the pressure chamber, said fixture, comprising a split die that when assembled forms a working surface in the desired shape to be formed from a said tube; (retained in) a sleeve which fits around the split die to retain it in an assembled state; (a tube to be formed,) an upper seal and a lower seal (between) located above and below the working surface of the split dies when assembled, said seals being sized to form a fluid tight seal between a said tube to be formed and the assembled die (and tube above the forming) a forming space between said working surface of said dies and said tube containing a compressible gas or a vacuum, (and a seal between the split dies and tube below the forming space between said dies and said tube); an inlet to (fill) said pressure chamber through which (with) said non-compressible liquid enters; an outlet (to exhaust air) from said chamber through which any air therein is exhausted as said non-compressible liquid is let in; and means to pressurize said non-compressible liquid in said chamber to a pressure at which said tube is isostatically bulge formed in said dies by pushing against the inside surface of the tube to force the outside surface into said forming space and against the working surface of the assembled dies.

6. The apparatus of claim 5 where the upper and lower seals are formed by O-rings located in grooves above and below the working surface of the said split dies.

* * * * *